United States Patent [19]

Merten et al.

[11] Patent Number: 4,571,127

[45] Date of Patent: Feb. 18, 1986

[54] ADVANCE MECHANISM FOR MINE ROOF SUPPORT UNITS

[75] Inventors: Gerhard Merten; Günter Lagodka, both of Lünen, Fed. Rep. of Germany

[73] Assignee: Gewerkschaft Eisenhutte Westfalia, Lünen, Fed. Rep. of Germany

[21] Appl. No.: 629,636

[22] Filed: Jul. 11, 1984

[51] Int. Cl.[4] ..... E21D 15/44; E21D 23/08

[52] U.S. Cl. ..... 405/299; 299/33

[58] Field of Search ..... 405/291, 299, 300, 301; 299/31, 33

[56] References Cited

U.S. PATENT DOCUMENTS 4,195,953 4/1980 Becker et al. ..... 405/300
4,217,067 8/1980 Lagodka et al. ..... 405/299 X
4,227,833 10/1980 Plester et al. ..... 405/299
4,379,661 4/1983 Wojaczek et al. ..... 405/299
4,390,308 6/1983 Becker et al. ..... 405/299

*Primary Examiner*—David H. Corbin
*Attorney, Agent, or Firm*—Maurice E. Gauthier

[57] ABSTRACT

A so-called externally-situated advance mechanism is arranged between the floor sills of adjacent mine roof support units. The advance mechanism includes two laterally-spaced guide rods, and two advance rams positioned above the guide rods. The front ends of the guide rods are connected to a head-piece. A bridge is connected to the two guide rods at a distance behind this head-piece. The piston rods of the two advance rams act on this bridge. The cylinders of the rams are connected, at a distance therebehind, to brackets fixed to the floor sills. Said brackets form guides for the guide rods.

9 Claims, 3 Drawing Figures

ADVANCE MECHANISM FOR MINE ROOF SUPPORT UNITS

BACKGROUND TO THE INVENTION

This invention relates to an advance mechanism for a mine roof support assembly.

A known type of mine roof support assembly is constituted by a plurality of roof support units positioned side-by-side along, for example, a longwall face. Each of the units has a roof shield supported on a floor sill by means of hydraulic props. In order to advance the assembly to follow the advance of the longwall face, the roof support units are advanced, individually or in groups, by means of advance mechanisms. During the advance of any given unit, its hydraulic props are relaxed so that its roof shield is not under load.

A known type of advance mechanism for such an assembly comprises a pair of resilient guide rods and a pair of hydraulic advance rams. Such advance mechanisms are positioned between the floor sills of each pair of adjacent roof support units. The front ends of the guide rods of such an advance mechanism are attached to a head-piece which is connected, for example, to a longwall conveyor. The rear ends of the guide rods are unconnected, and are slidably guided in rod guides provided on the adjacent floor sills. The piston rods of the rams of each advance mechanism are attached to the front regions of the associated floor sills, and their cylinders are attached to the rear ends of the guide rods. Thus, the forces which advance the roof support units are transmitted through the full length of the guide rods. The rams of this type of mechanism are known as "braced-in" rams. (See DE-OS No. 27 58 663 and DE-OS No. 29 40 401).

The aim of the invention is to provide an advance mechanism of this type, which mechanism is of simple and space-saving construction style, and in particular has a low overall width, so that it is possible to dispense with the braced-in rams in favour of direct-acting rams. The advance mechanism should be such that extensive adjustability of the floor sills of the roof support units is possible, so that the mechanism can be used even with the known systems which are used to control the cutting horizon of a winning machine such as a coal plough.

SUMMARY OF THE INVENTION

The present invention provides in a mineral mining installation comprising a longwall conveyor, a plurality of roof support units positioned side-by-side on the goaf side of the conveyor, each roof support unit having a floor sill, and a respective advance mechanism positioned between the floor sills of each pair of adjacent roof support units, each advance mechanism comprising a pair of generally parallel guide rods and a pair of generally parallel hydraulic advance rams, the guide rods of each advance mechanism being interconnected at one end by a head-piece attached to the conveyor, and the guide rods of each advance mechanism being slidably guided in guides attached to the two adjacent floor sills, the improvements comprising positioning the guide rods of each advance mechanism beneath the associated hydraulic rams, connecting said guide rods together by a bridge positioned between the associated head-piece and the other ends thereof, providing the floor sills associated with said guide rods with brackets positioned between said bridge and said other ends of said guide rods, and pivotally mounting each of said associated hydraulic rams between a respective one of said brackets and said bridge.

Advantageously, the piston rods of said hydraulic rams are attached to the bridge by pivot joints, and the cylinders of said hydraulic rams are attached to said brackets by pivot joints.

In this advance mechanism, therefore, the advance rams are interposed between the floor sills of the adjacent roof support units and the guide rods so that their pivotal attachments to the bridge lie in front (with respect to the direction of advance) of their pivotal attachments to the floor sills.

The forces used to advance the conveyor are thus transmitted directly through the forward end regions of the guide rods. In this case, the guide rods and the advance rams lie in a space-saving manner, without obstructing the longwall working, in the gaps between the floor sills of the adjacent roof support units. A simple and space-saving arrangement is obtained because the connection between the cylinders of the advance rams and the floor sills is achieved using simple brackets fixed to the sides of the floor sills, and by positioning the advance rams closely above the two guide rods, preferably with a short lateral spacing. Since the guide rods, which are unconnected at their rear ends, are guided at regions behind the bridge in the rod guides provided on the floor sills, satisfactory guidance of the roof support units results, while extensive freedom of movement is preserved. Moreover, the advance mechanism can be provided, if necessary, with a control ram for adjustment of the cutting horizon of a winning machine.

In a preferred embodiment, each of said brackets is provided with a guide aperture through which the associated guide rod passes, said brackets thereby forming said guides. The brackets thus form simple parts which can be attached to the associated floor sills, the brackets constituting articulated attachment points for the cylinders of the associated advance rams and guides for the guide rods.

Advantageously, said bridge is detachably attached to said guide rods thereby permitting longitudinal adjustment of said bridge relative to said guide rods. Thus, it is possible to adjust the gap between the roof support units and the conveyor. Preferably, said bridge is of two-part construction, having a first bridge part engaging beneath said two guide rods, and a second bridge part engaging over said two guide rods, and the two bridge parts are clamped together and to said guide rods by means of clamping elements.

Conveniently, said guide rods are outwardly off-set towards the associated floor sills in the region between said bridge and their other ends, whereby said guide rods are spaced apart by a shorter distance in the region of said bridge than in the region between said off-set portions and said other ends of said guide rods. This arrangement results in a narrow style of construction of the entire advance mechanism with relatively small bridge dimensions. At the same time, good lateral guidance of the roof support units is ensured, since the guide rods can be arranged, in the region between the bridge and their rear ends, close beside the side faces of the floor sills, and thus can laterally support the floor sills over a relatively large length.

Advantageously, said guide rods are outwardly off-set at the ends thereof connected to said head-piece. This ensures a firm connection between the guide rods and the head-piece, and that the width of the head-piece is sufficiently large to permit the mounting of a control ram. In this case, said head-piece may be provided with a joint bearing for the attachment of a hydraulic control ram.

Preferably, said guide rods are of circular cross-section, and are made of resilient material.

BRIEF DESCRIPTION OF THE DRAWINGS

A mine roof support assembly incorporating advance mechanisms constructed in accordance with the invention will now be described, by way of example, with reference to the accompanying drawings, in which.

DESCRIPTION OF PREFERRED EMBODIMENT

Figure 1:
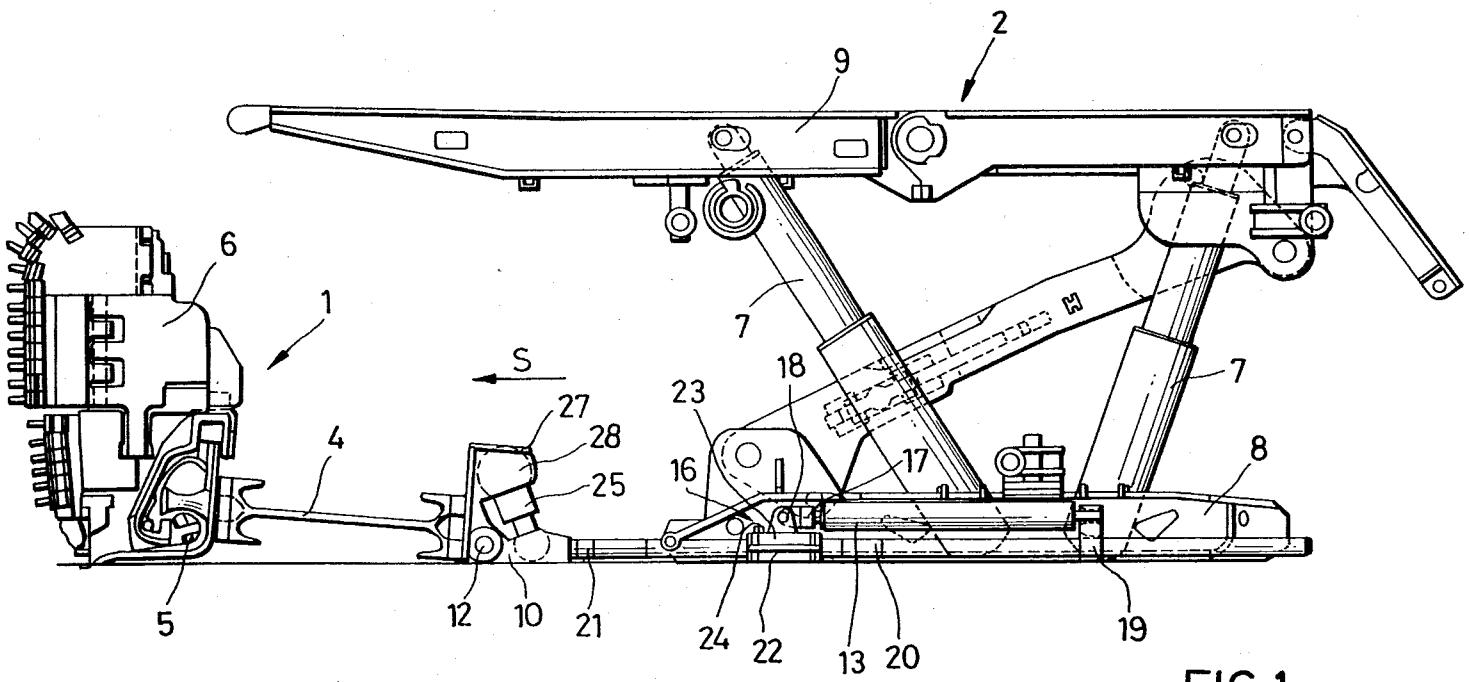
FIG. 1 is a side elevation of one roof support unit of the assembly, together with one advance mechanism therefor.

Referring to the drawings, FIG. 1 shows a mineral mining installation 1, and a hydraulic roof support unit 2. The roof support unit 2 forms part of a roof support assembly positioned on the goaf side of the installation, the roof support assembly being constituted by a plurality of roof support units 2. Each roof support unit 2 is connected to the installation 1 by means of advance mechanisms 3 arranged on either side thereof. The installation 1 is constituted by a scraper-chain conveyor 4, a plough guide 5 attached to the face side of the conveyor, and a coal plough 6 mounted on the guide.

Each roof support unit 2 includes a plurality of hydraulic props 7 which are supported in foot joints on a common, one-piece floor sill 8. The props 7 support a multi-part roof bar 9, which supports the roof in the region between the working face and the goaf space.

Figure 2:
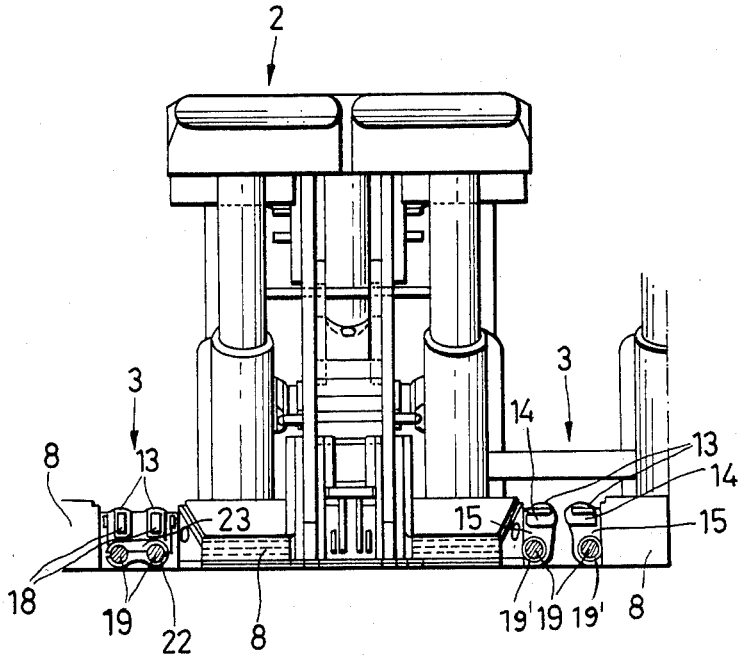
FIG. 2 is a part-sectional elevation, as seen from the face, of the arrangement shown in FIG. 1.
Figure 3:
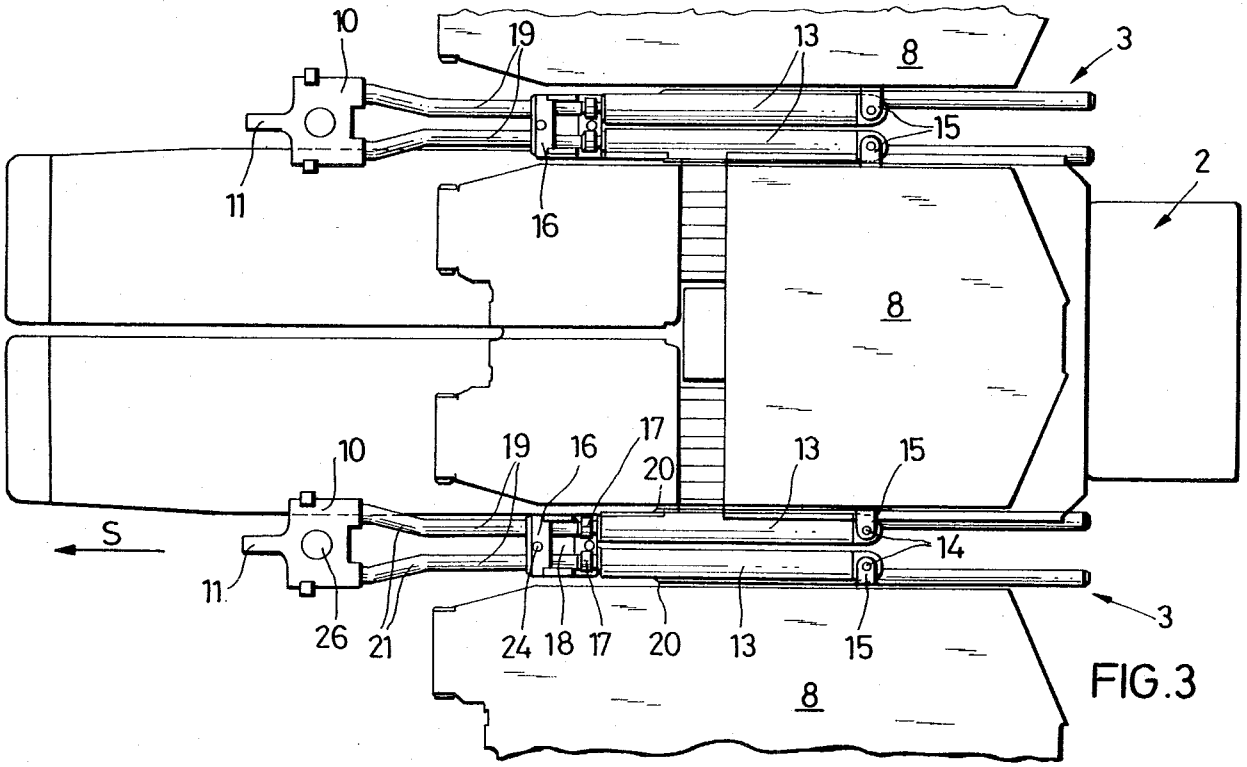
FIG. 3 is a plan view of the arrangement shown in FIG. 1.

FIGS. 2 and 3 show the floor sills 8 of three adjacent roof support units 2, and two advance mechanisms 3 which lie in the gaps between the floor sills of each pair of adjacent roof support units. Each advance mechanism 3 includes two generally parallel guide rods 19, whose front (face-side) ends are attached to a common head-piece 10. The guide rods 19 are of circular cross-section, and are made of resilient material. At their rear (goaf-side) ends, the two guide rods 19 are unconnected (see FIG. 3). The head-piece 10 has a tongue 11, by means of which it can be attached to the goaf side of the conveyor 4 by a bolt joint 12 (see FIG. 1). Each advance mechanism 3 also includes two parallel, laterally-spaced hydraulic advance rams 13. The cylinders of the rams 13 are attached, by pivot joints 14, to brackets 15 fixed to the two adjacent floor sills 8. The brackets 15 may be fixed to the floor sills 8 in such a manner that they can be repositioned along the floor sills. Between the head-piece 10 and the brackets 15, the guide rods 19 are connected by a bridge 16. The piston rods 17 of the two advance rams 13 are attached to the bridge 16 by pivot joints 18 having horizontal pivot axes. The advance rams 13 are, therefore, articulatedly interposed between the bridge 16 and the associated floor sills 8. The pivot joints 14 and 18 also have limited articulated freedom in the other axial directions.

The brackets 15 are provided with circular apertures 19' (see the right of FIG. 2) through which the guide rods 19 extend with play. These apertures 19' thus form rod guides, and they lie beneath the pivot joints 14 of the two rams 13. Alternatively, the apertures 19' may be oval.

In use, extension of the rams 13 causes their piston rods 17 to advance the installation 1 in the direction of the arrow S by means of the bridge 16 and the two guide rods 19. The roof support units 2, which are braced between the roof and floor of the working, form an abutment for this advance movement. In order to advance a given roof support unit 2 in a follow-up step, the two rams 13 associated with that unit (that is to say the adjacent rams of the two adjacent advance mechanisms 3) are retracted. The installation 1 forms an abutment for this follow-up advance movement. During this follow-up advance movement, the floor sill 8 of the roof support unit 2 is guided by the associated guide rods 19 of the two adjacent advance mechanisms 3.

As can best be seen in FIG. 3, the two rams 13 of each advance mechanism 3 are spaced apart by a short distance, and lie above the two associated guide rods 19. The two guide rods 19 have a greater lateral spacing in the region between the bridge 16 and their rear ends than in the region of the bridge 16 and in the region between the bridge and the head-piece 10. Accordingly, the two guide rods 19 are outwardly offset, at 20, behind the bridge 16, so that, in this region, they are situated close to the side face of the associated floor sill 8. Towards their front ends, the guide rods 19 are outwardly off-set, at 21, these off-set ends being fixed to the head-piece 10. Since the spacing between the guide rods 19 in the region between the cranked portions 20 and 21 is less than in the remaining regions, the bridge 16 can have a relatively small overall width, which is not greater than approximately the sum of the diameters of the cylinders of the two rams 13 lying closely side-by-side.

The bridge 16 is preferably formed so that it can be adjusted longitudinally with respect to the two guide rods 19. Accordingly, the bridge 16 is of two-part construction, being constituted by a bridge part 22 engaging beneath the two guide rods 19 and a bridge part 23 engaging over the two guide rods, the two bridge parts 22 and 23 being provided with complementary recesses for receiving the guide rods. The bridge parts 22 and 23 are fixed together, and braced against the guide rods 19 by means of bolts 24. The upper bridge part 23 supports the pivot joints 18.

The head-piece 10 of each advance mechanism 3 is so formed as to permit the attachment of a hydraulic control ram 25 which is used to tilt the installation 1 in the plane perpendicular to the floor of the working in order to adjust the cutting horizon of the plough 6. For this purpose, each head-piece 10 has a socket 26 for receiving a ball provided on the piston rod of the ram 25. Upstanding brackets 27 are fixed to the goaf side of the conveyor 4, these brackets being provided with sockets 28 for receiving balls provided on the cylinders of the rams 25.

The type of advance mechanism described above permits a reliable, constraint-free guidance of the associated roof support units 2 as they are advanced to follow up the advance of the installation 1, whilst preserving extensive freedom of movement which is necessary for adaptation to irregularities of the floor of the working.

It will be understood that this type of advance mechanism could be used with roof support units of different kinds.

We claim:

1. In a mineral mining installation comprising a long-wall conveyor, a plurality of roof support units positioned side-by-side on the goaf side of the conveyor, each roof support unit having a floor sill, and a respective advance mechanism positioned between the floor sills of each pair of adjacent roof support units, each advance mechanism comprising a pair of generally parallel guide rods and a pair of generally parallel hydraulic advance rams, the guide rods of each advance mechanism being interconnected at one end by a head-piece attached to the conveyor, and the guide rods of each advance mechanism being slidably guided in guides attached to the two adjacent floor sills, the improvements comprising positioning the guide rods of each advance mechanism beneath the associated hydraulic rams, connecting said guide rods together by a bridge positioned between the associated head-piece and the other ends thereof, providing the floor sills associated with said guide rods with brackets positioned between said bridge and said other ends of said guide rods, and pivotally mounting each of said associated hydraulic rams between a respective one of said brackets and said bridge.

2. An advance mechanism according to claim 1, wherein the piston rods of said hydraulic rams are attached to the bridge by pivot joints, and the cylinders of said hydraulic rams are attached to said brackets by pivot joints.

3. An advance mechanism according to claim 1, wherein each of said brackets is provided with a guide aperture through which the associated guide rod passes, said brackets thereby forming said guides.

4. An advance mechanism according to claim 1, wherein said bridge is detachably attached to said guide rods thereby permitting longitudinal adjustment of said bridge relative to said guide rods.

5. An advance mechanism according to claim 4, wherein said bridge is of two-part construction, having a first bridge part engaging beneath said two guide rods, and a second bridge part engaging over said two guide rods, and wherein the two bridge parts are clamped together and to said guide rods by means of clamping elements.

6. An advance mechanism according to claim 1, wherein said guide rods are outwardly off-set towards the associated floor sills in the region between said bridge and their other ends, whereby said guide rods are spaced apart by a shorter distance in the region of said bridge than in the region between said off-set portions and said other ends of said guide rods.

7. An advance mechanism according to claim 6, wherein said guide rods are outwardly off-set at the ends thereof connected to said head-piece.

8. An advance mechanism according to claim 1, wherein said guide rods are of circular cross-section, and are made of resilient material.

9. An advance mechanism according to claim 1, wherein said head-piece is provided with a joint bearing for the attachment of a hydraulic control ram.

* * * * *